US007147611B2

(12) United States Patent
Kassel et al.

(10) Patent No.: US 7,147,611 B2
(45) Date of Patent: Dec. 12, 2006

(54) MASSAGE DEVICE

(76) Inventors: Arthur Michael Kassel, 511 Foothill, Beverly Hills, CA (US) 90210; Kenneth Owen Richardson, P.O. Box 2254, Whittier, CA (US) 90610

( * ) Notice: Subject to any disclaimer, the term of this patent is extended or adjusted under 35 U.S.C. 154(b) by 37 days.

(21) Appl. No.: 11/245,840

(22) Filed: Oct. 7, 2005

(65) Prior Publication Data

US 2006/0030800 A1 Feb. 9, 2006

Related U.S. Application Data

(63) Continuation of application No. PCT/US2004/011123, filed on Apr. 9, 2004.

(60) Provisional application No. 60/461,488, filed on Apr. 9, 2003.

(51) Int. Cl.
*A61H 7/00* (2006.01)

(52) U.S. Cl. ..... 601/90; 601/93; 601/98; 601/101; 601/133

(58) Field of Classification Search ..... 601/22, 601/23, 27–29, 30–35, 89–94, 97–99, 101–104, 601/112, 115, 116, 126, 133, 134
See application file for complete search history.

(56) References Cited

U.S. PATENT DOCUMENTS 6,213,962 B1 * 4/2001 Shimizu ..... 601/93
6,491,652 B1 12/2002 Hata et al.
6,599,261 B1 * 7/2003 Chen ..... 601/115
6,629,940 B1 * 10/2003 Shimizu ..... 601/133
2002/0161316 A1 10/2002 Shimizu
2004/0186399 A1 * 9/2004 Tseng ..... 601/112
2004/0243029 A1 * 12/2004 Shimizu ..... 601/90

FOREIGN PATENT DOCUMENTS

WO WO2004/091466 A3 10/2004

* cited by examiner

*Primary Examiner*—Quang D. Thanh
(74) *Attorney, Agent, or Firm*—Howard M. Cohn

(57) ABSTRACT

The present invention is a massage device (10) for massaging one or more body parts. The device includes a first paddle (61) extending outward from the side of a housing (78) that is rotatably mounted on a wobble bearing journal (56) of a wobble bearing (72, 74); a drive shaft (38) from a rotational motive device (32, 34) that is rotationally engaged with a passage (57) of the journal (56), wherein the passage (57) passes through the journal (56) at a non-zero wobble angle (θ) measured between a rotational axis (RA) of the drive shaft (38) and the geometric axis of revolution (CS) of the journal (56); a detaining fin (62) attached to the housing (78) and encompassing a detaining rod (36); and a frame (40) that fixedly holds the detaining rod (36) and rotational holds the drive shaft (38).

9 Claims, 4 Drawing Sheets

MASSAGE DEVICE

CROSS-REFERENCE TO RELATED APPLICATIONS

This application claims the benefit of U.S. Provisional Patent Application No. 60/461,488, filed Apr. 9, 2003 which is incorporated herein by reference.

This application is a continuation of copending PCT Patent Application No. PCT/US2004/011123, filed Apr. 9, 2004, which is incorporated herein by reference.

TECHNICAL FIELD

The present invention relates generally to massage devices, more particularly to a massage device for body appendages, and most particularly to a leg massage device for use by a person that does not have enough blood circulation through their legs.

BACKGROUND OF THE INVENTION

Generally, a massage device is used to obtain selected stroking, rubbing and/or kneading massaging effects of the human body to increase the blood flow and obtain muscle relaxation. A body massage may be divided into three levels of rising intensities. The first level, known in the art as stroking, involves a smoothing action characterized by mild to medium pressure applied onto a body part being massaged. Stroking is meant to warm-up and thereby prepare the body part being massaged for the following massage levels. The second level, known in the art as rubbing, involves pressing and rubbing actions characterized by movement of the tissue and medium to high pressure applied on the body part being massaged. Rubbing is meant to increase the blood flow in the body part being massaged. The third level, known in the art as kneading, involves pressing and kneading actions characterized by high pressure applied onto the body part being massaged. Kneading is typically a deep and thorough muscle massage extending over a relatively prolonged time of minutes or more.

Such massage devices may be categorized into a vibration-type massage device and a kneading/rubbing-type massage device. The vibration-type massage is designed to convert a rotation movement of a motor into a vibration movement of a massage head. The kneading/rubbing-type massage device is designed to convert a rotation movement into a rubbing/kneading movement of a massage element.

A vibration-type massage device is often used for providing vibration-type massage of various parts of the body. Particularly in the case of leg massage, it is used to automatically massage the sole of the foot by applying vibration thereto.

A portable, kneading-type massage device that is adjustable for automatically massaging body appendages, particularly the leg, and especially the calf, is desired. A variety of manual tools such as a wooden stick, a bottle, and a roller have been disclosed to use hand pressure for rubbing the calf. The use of the manual tools for massaging the leg is troublesome.

Moreover, a massage device, as disclosed in U.S. Pat. No. 6,551,260 (Suh, 2003), has been developed that can be used for a particular part of the human body and operated in a variety of patterns. In the U.S. Pat. No. 6,551,260 , "A massage device includes a main body provided with a supporting groove in which a calf of a leg can be disposed, a sliding member slidably inserted into the main body, and a first massager for massaging the calf. The first massager is installed on a rear side of the supporting groove and includes an electric motor, a power transmission device for converting a rotational motion of the motor into a reciprocal motion, and a first massage member for massaging the calf while moving along the supporting groove. . . . First massage members (42) move along the calf in the vertical direction to rub the calf. In addition, the first massaging means may further comprise second massage members (66) that can apply pressure to the calf and release the pressure from the calf so as to perform the kneading massage. The second massage member (66) comprises an air pump (20) and plural pressing members (68) mounted inside the supporting grooves (28). The second massage member (66) kneads the calf as the air pump supplies and exhausts the air to and from the pressing members (68) at a predetermined cycle."

However, a portable, kneading-type massage device that is adjustable for automatically massaging body appendages, particularly the leg, is not known. Furthermore, a portable, kneading-type massage device that is adjustable for automatically massaging any body parts (e.g., the neck or back/torso) is also not known. Therefore there is a need to adjust the width of the space which supports a body part (e.g., leg) so as to accommodate different sized body parts (e.g., legs vs. arms; e.g., different sized calves), as well as to change the intensity of the massage. Thus it is an object of the present invention to address the need for adjustable, portable, kneading-type massage devices for body parts.

SUMMARY OF THE INVENTION

According to the invention there is disclosed a massage device for massaging one or more body parts. The device is characterized by: a first paddle extending outward from the side of a housing that is rotatably mounted on a wobble bearing journal of a wobble bearing; a drive shaft from a rotational motive device that is rotationally engaged with a passage of the journal, wherein the passage passes through the journal at a non-zero wobble angle (θ) measured between a rotational axis (RA) of the drive shaft and the geometric axis of revolution of the journal; a detaining fin attached to the housing and encompassing a detaining rod; and a frame that fixedly holds the detaining rod and rotational holds the drive shaft.

Further according to the invention there is disclosed a massage device further characterized by: flexible support components adapted to support a body part; and a forked paddle wherein: the first paddle extends roughly vertically along a side of the support components; and a second paddle extends roughly horizontally from the first paddle and under a bottom of the support components.

Still further according to the invention there is disclosed a massage device characterized by: a trough shape for the flexible support components having two opposed sides and one bottom; and a paddle set that is a first forked paddle arranged on one of the two opposed sides, and a second forked paddle arranged on the other one of the two opposed sides.

Yet further according to the invention, there is disclosed a massage device characterized by: a single drive shaft that is rotationally engaged with both of a first wobble bearing that is associated with the first forked paddle, and a second wobble bearing that is associated with the second forked paddle.

Further according to the invention there is disclosed a massage device further characterized by an adjuster connected to at least one of the first and second wobble bearings for longitudinal sliding adjustment of wobble bearing position along the drive shaft.

Still further according to the invention there is disclosed a massage device further characterized by: a first trough shape for the flexible support components and a roughly parallel second trough shape for the flexible support components; and a first paddle set arranged about the first trough shape for the flexible support components and a similar second paddle set arranged about the second trough shape for the flexible support components.

Yet further according to the invention, there is disclosed a massage device further characterized by a wobble angle (θ) in the range of between about 1° and about 15°, preferably in the range of between about 2° and about 10° and most preferably in the range of between about 2° and about 7°.

Still further according to the invention there is disclosed a massage device characterized by a remote control for controlling massage intensity.

According to the invention there is disclosed a method for massaging one or more body parts. The method includes the steps of: extending a first massaging paddle outward from the side of a housing of a wobble bearing having a journal that nutates about a rotational angle; and preventing the housing from rotating, thereby producing a twisting and waving motion in the first paddle for applying kneading-type and rubbing-type massage to the body part.

Further according to the invention there is disclosed a method for massaging one or more body parts including the steps of extending a second massaging paddle outward from the side of a housing of a wobble bearing having a journal that nutates about a rotational angle for applying kneading-type and rubbing-type massage to the body part.

Still further according to the invention there is disclosed a method for massaging one or more body parts including the steps of constructing the first and second massaging paddles of two forked paddles; constructing each of the two forked paddles of a first paddle and a second paddle that extends substantially horizontally from the first forked paddle; and producing a twisting and waving motion in the first and second forked paddles for applying kneading-type and rubbing-type massage to the three sides of a body part.

Further according to the invention there is disclosed a method for massaging one or more body parts including the steps of providing a flexible support component adapted to support a body part; and contacting the sides and bottom of the flexible support component with the forked paddle, wherein the first paddle extends substantially vertically along a side of the support component; and the second paddle extends substantially horizontally from the first paddle and under a bottom of the support components.

Still further according to the invention there is disclosed a method for massaging one or more body parts including the steps of adjusting the distance between the two pairs of first and second massaging paddles.

Further according to the invention there is disclosed a method for massaging one or more body parts including the step of providing a pair of first and second and a pair of flexible support components for massaging a pair of body parts.

Other objects, features and advantages of the invention will become apparent in light of the following description thereof.

BRIEF DESCRIPTION OF THE DRAWINGS

Reference will be made in detail to preferred embodiments of the invention, examples of which are illustrated in the accompanying drawing figures. The figures are intended to be illustrative, not limiting. Although the invention is generally described in the context of these preferred embodiments, it should be understood that it is not intended to limit the spirit and scope of the invention to these particular embodiments.

Certain elements in selected ones of the drawings may be illustrated not-to-scale, for illustrative clarity. The cross-sectional views, if any, presented herein may be in the form of "slices", or "near-sighted" cross-sectional views, omitting certain background lines which would otherwise be visible in a true cross-sectional view, for illustrative clarity.

Elements of the figures can be numbered such that similar (including identical) elements may be referred to with similar numbers in a single drawing. For example, each of a plurality of elements collectively referred to as 199 may be referred to individually as 199*a*, 199*b*, 199*c*, etc. Or, related but modified elements may have the same number but are distinguished by primes. For example, 109, 109', and 109" are three different elements which are similar or related in some way, but have significant modifications, e.g., a tire 109 having a static imbalance versus a different tire 109' of the same design, but having a couple imbalance. Such relationships, if any, between similar elements in the same or different figures will become apparent throughout the specification, including, if applicable, in the claims and abstract.

Figures 1, 2:
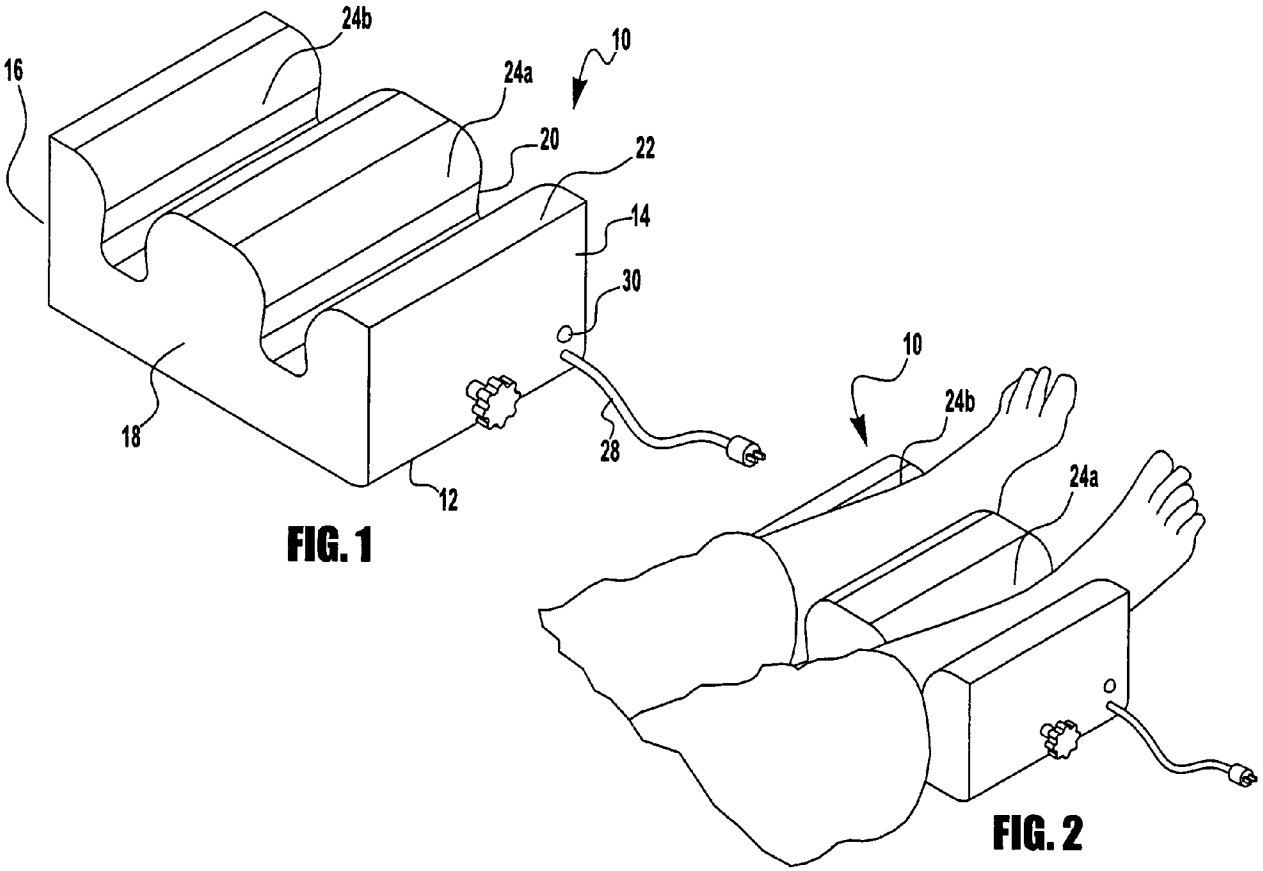
Figure 3:
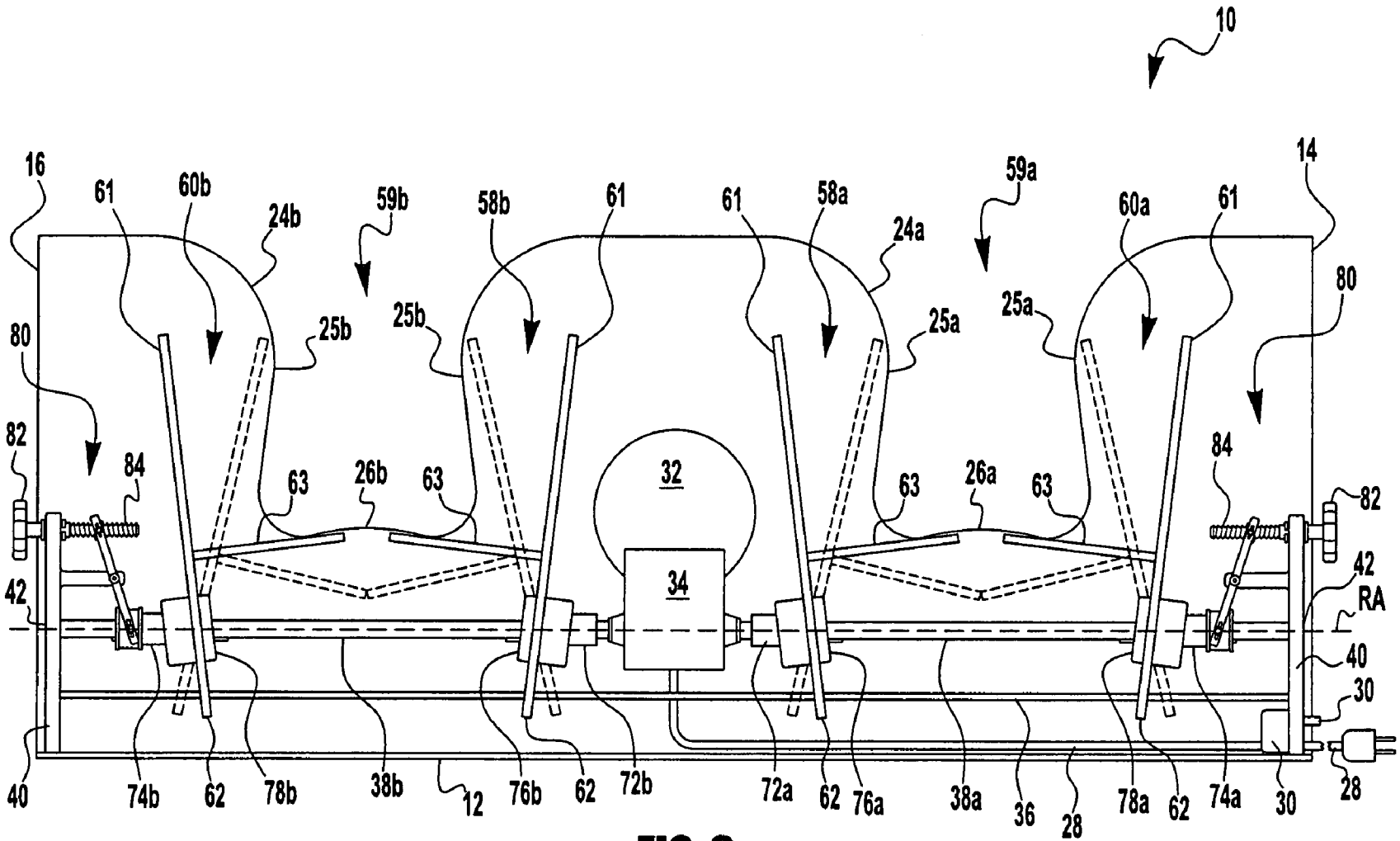
Figure 4:
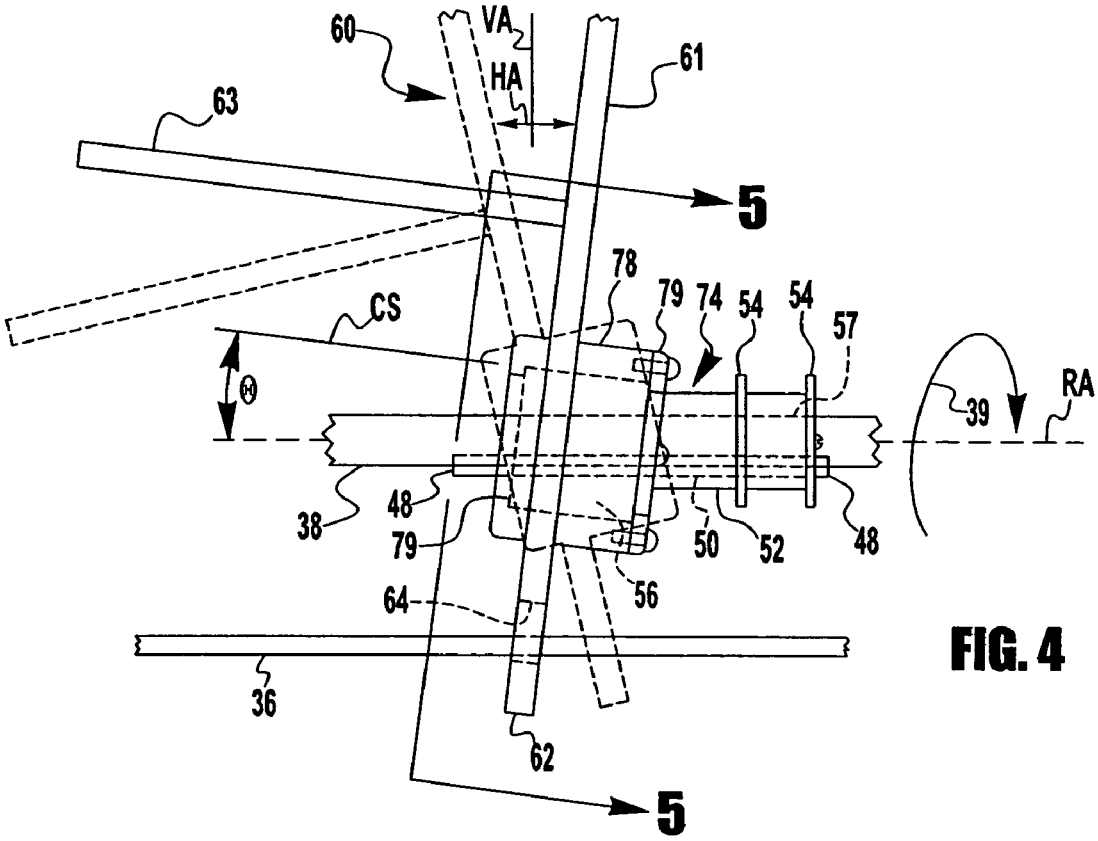
Figure 5:
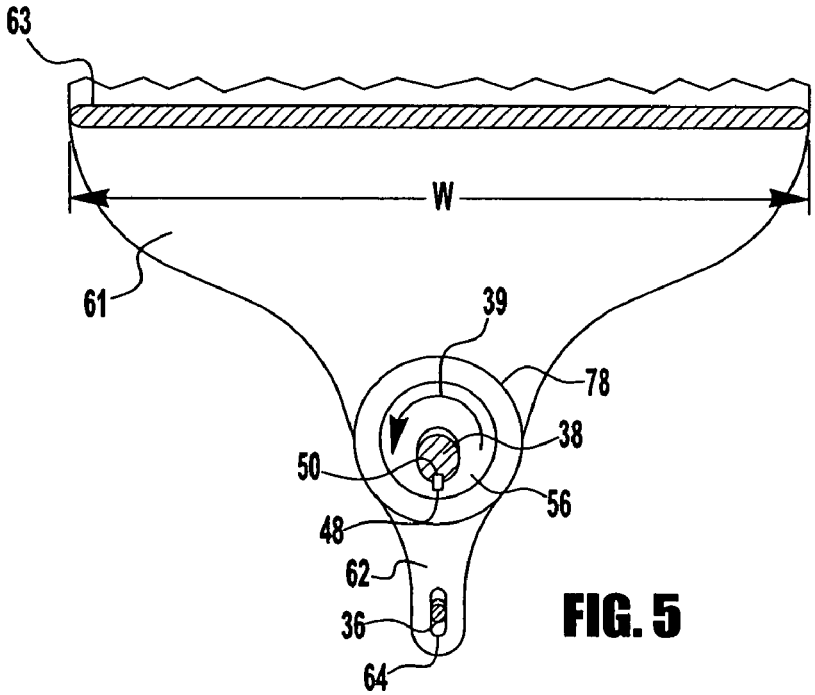
Figures 6, 7:
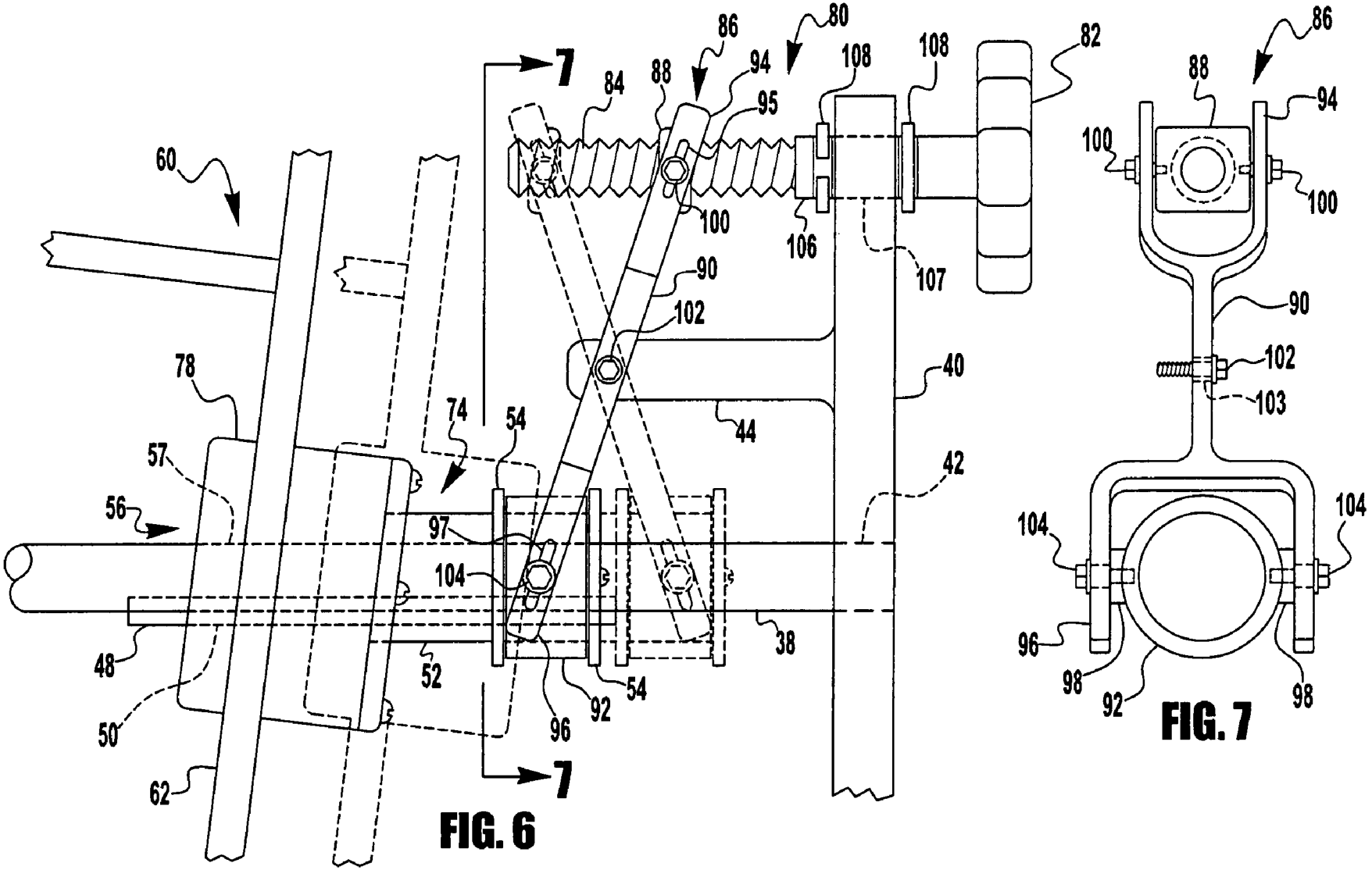

These and other features of the present invention will be apparent with reference to the following description and drawings wherein:

FIG. 1 is a perspective view of a leg massage device, being a preferred embodiment of the present invention;

FIG. 2 is a cut-away perspective view of the legs of a person disposed within the massage device of FIG. 1, according to the invention;

FIG. 3 is a cut-away front view of the massage device of FIG. 1 showing an operating mechanism within the massage device, according to the invention;

FIG. 4 is a detailed front view of a portion of a forked paddle on a wobble bearing slidingly attached to a portion of a rotating drive shaft, according to the invention;

FIG. 5 is a side cross-sectional view taken along the line 5—5 in FIG. 4 of a portion of the forked paddle on the wobble bearing, according to the invention;

FIG. 6 is a detailed front view of the bearing housing mounted on the wobble bearing on a portion of the drive shaft and an adjuster for positioning the wobble bearing along the drive shaft, according to the invention; and FIG. 7 is a side view taken along the line 7—7 in FIG. 6 of a lever assembly of the adjuster, according to the invention.

DETAILED DESCRIPTION OF THE INVENTION

The present invention generally comprises a massage device (massager) for providing primarily kneading-type massage of any suitable body part including, for example, appendages (e.g., legs, arms) preferably as a pair, or other body parts such as the back (e.g., torso, shoulders), the neck, etc. The invention will be described as its preferred embodiment, a leg massager for simultaneous, automatic massage of both legs, but given the teachings herein it should be apparent that the inventive principles can be similarly applied to massagers for other body parts, singly or in pairs, simply by changing dimensions and/or quantities of appropriate parts of the inventive massager. Furthermore, it will become apparent from the disclosure hereinbelow that the inventive massage device not only provides more than one kind of kneading-type massage (e.g., squeezing/pressing and rolling), but also simultaneously provides a lesser amount of rubbing-type massage.

A leg massage device 10, shown in FIG. 1, is a box-like structure having a base 12, two sidewalls 14, 16, front and rear surfaces 18, 20, respectively, and a top surface 22. First and second contoured support components 24*a*, 24*b* (collectively referred to as support components 24) extend from the top surface 22 down along the front and rear surfaces 18, 20, thereby forming essentially three-sided troughs, each having two sides 25 (shown as first sides 25*a* and second sides 25*b*) and one bottom 26 (shown as a first bottom 26*a* and a second bottom 26*b*). The support components 24 are constructed of a flexible but mostly non-stretchable material, however portions of the contoured support components 24 may be made of a stretchy material in order to mold itself to the shape of the body part being massaged in the massage device 10.

An electric cord 28 extends from the sidewall 14 and power from the cord 28 is controlled by a switch 30. While the massager 10 can be operated with a simple on-off switch 30, it is also within the scope of the present invention to turn the massager 10 on and off with a switch 30 that is in the form of a remote control, either on an umbilical cord or cordless. It is also within the scope of the invention that the switch 30 has multiple positions corresponding to various speed settings for varying the speed of the massager's motor and thereby varying the cycle speed of the massage, according to user preference.

Referring to FIG. 2, there is illustrated the legs of a person using the leg massage device 10 with their calves placed in the support components 24. The contoured support components 24 are made of a flexible material which conforms to the shape of the person's leg. It should be apparent that an equivalent leg massage device 10, possibly with larger support components 24, could be used with the person's thighs placed in the support components 24.

Referring to FIG. 3, there is illustrated a front view of the leg massage device 10 with the front surface 18 removed so that the inner operating components of the massage device 10 can be seen. Although no particular thickness is shown for the outside surfaces of the device 10, it should be understood that at least the ends 14, 16 should be relatively stiff, and that the support components 24 will preferably have a resilient material inside, either as a layer of padding or possibly even as a resilient filling (e.g., rubber foam) that fills the interior of the massage device 10 around the inner operating components. Alternatively, the support components 24 can be made of a thin, slippery material (e.g., nylon) and paddles 61, 63 of the massager 10 can be padded and/or made of a flexible, semi-rigid material (e.g., soft plastic). In the center of the massage device 10, there is disposed a motive device, preferably an electric motor 32, which is connected to a source of electric power through an electric cord 28 that passes through the switch 30 for power control. A gear box 34 translates motor rotation into continuous unidirectional rotation of the first and second drive shafts 38*a*, 38*b* (collectively referred to as drive shafts 38) about a rotational axis RA. . . . The drive shafts 38 are substantially identical, but may either be in two pieces that rotate in the same or opposite directions, or may be two ends of a single drive shaft. At each of the device ends 14, 16 a frame 40 extends upward from the base 12 and rotationally holds a respective outer end of the drive shafts 38, for example in a sleeve bearing 42. A detaining rod 36, whose function will be detailed below, extends approximately parallel to the drive shafts 38 between the device ends 14 and 16 where it is held in a fixed position by being attached to the frame 40 at both ends 14, 16.

The first and second drive shafts 38*a*, 38*b* extend outward from the gear box 34 through first and second fixed wobble bearings 72*a*, 72*b* respectively, and then through first and second adjustable wobble bearings 74*a*, 74*b* respectively. An adjuster 80 is mounted on the frame 40 at each end 14, 16, and provides a knob 82 on a threaded drive screw 84 for manual adjustment of the sliding position of the adjustable wobble bearings 74*a*, 74*b* in and out along the drive shafts 38. It is within the scope of the invention for the two adjusters 80 to be mounted differently on the frame 40, for example behind and/or below the drive shafts 38, thereby allowing the drive screw 84 to extend from the frame 40 on the first end 14 all the way over to the frame 40 on the opposite end 16. In this case, a single drive screw 84 (probably having reversed threads at one end) and a single knob 82 could be used to simultaneously adjust both first and second adjustable wobble bearings 74*a*, 74*b*. It is further within the scope of the invention to add an adjuster 80 to one or both of the inside wobble bearings 72*a*, 72*b*, substituting an adjustable wobble bearing (e.g., 74*a*, 74*b*) for the fixed wobble bearings 72*a*, 72*b*, thereby allowing manual adjustment of the sliding position of the inside wobble bearings 72*a*, 72*b* in and out along the drive shafts 38. In this way a single drive screw 84 (probably having reversed threads at alternated adjuster 80 positions) and a single knob 82 can be used to simultaneously adjust paired sets of inside and outside wobble bearings 72*a*/74*a*, and 72*b*/74*b*.

Still referring to FIG. 3, first and second inside bearing housings 76*a*, 76*b*, are rotatably mounted on the first and second fixed wobble bearings 72*a*, 72*b* respectively, and first and second outside bearing housings 78*a*, 78*b*, are rotatably mounted on the first and second adjustable wobble bearings 74*a*, 74*b* respectively. A detaining fin 62 extends downward from each inside and outside bearing housing 76*a*, 76*b*, 78*a*, 78*b* and encompasses the detaining rod 36 in a manner to be detailed below. First and second sets of paddles 59*a* and 59*b* (collectively referred to as paddle sets 59) are illustrated. The first paddle set 59*a* comprises a first inside forked paddle 58*a* and a first outside forked paddle 60*a;* the second paddle set 59*b* comprises a second inside forked paddle 58*b* and a second outside forked paddle 60*b*. Each of the forked paddles 58*a*, 58*b*, 60*a*, 60*b* has a side paddle 61 extending roughly vertically from the respective bearing housing 76*a*, 76*b*, 78*a*, 78*b;* and also has a bottom paddle 63 extending roughly horizontally from the side paddle 61 of the respective forked paddle 58*a*, 58*b*, 60*a*, 60*b*. Each of the paddle sets 59 is arranged such that the side paddle 60 of the inside forked paddle 58*a*, 58*b* and the corresponding side paddle 60 of the respective outside forked paddle 60*a*, 60*b* simultaneously wobble together to kneadingly press against first and second sides 25*a*, 25*b* of their respective first and second support components 24*a*, 24*b* as shown in the dashed-line illustration of the paddle sets 59; and subsequently simultaneously wobble apart, away from the first and second sides 25*a*, 25*b* of their respective first and second support components 24*a*, 24*b* to a position as shown in the solid-line illustration. Furthermore, because they are fixedly attached at a forked, approximately right angle to the side paddles 61, the bottom paddles 63 of the first and second paddle sets 59*a*, 59*b* will simultaneously wobble upward to kneadingly press against the respective first and second bottoms 26*a*, 26*b* of their respective first and second support components 24*a*, 24*b* as shown in the solid-line illustration of the paddle sets 59; and subsequently will simultaneously wobble downward, away from the first and second bottoms 26*a*, 26*b* of their respective first and second support components 24*a*, 24*b* to a position as shown in the dashed-line illustration. It can be seen that the upward movement of the bottom paddles 63 alternates with the moving together of the side paddles 61. It is intended that the first inside forked paddle 58*a* moves simultaneously with the first outside forked paddle 60*a* as described above, and similarly that the second inside forked paddle 58*b* moves simultaneously with the second outside forked paddle 60*b* as described above; but it is within the scope of the invention that the first paddle set 59*a* may or may not be moving in synchrony (simultaneously) with the second paddle set 59*b*.

To further understand the operation of the forked paddles 58*a*, 58*b*, 60*a*, 60*b*, please refer to FIGS. 4 and 5. FIG. 4 is a front view, and FIG. 5 is a side cross-sectional view (along the line 5—5) of a representative forked paddle 60 fixedly attached to and extending from a representative bearing housing 78 that is rotatably mounted on a representative wobble bearing 74 that is slidingly attached to a representative rotating drive shaft 38. Although an adjustable wobble bearing 74 is illustrated, it has the same parts and same actions related to the wobbling action as a fixed wobble bearing 72, differing only in details concerning sliding adjustment of the adjustable wobble bearing 74 which will be detailed below with reference to FIGS. 6 and 7. In fact, an adjustable wobble bearing 74 can be used in place of each of the fixed wobble bearings 72 as long as a means for fixedly attaching the adjustable wobble bearing 74 on the drive shaft 38 is provided (e.g., a set screw, e.g., a wedge-shaped key). It can be seen that the outside bearing housings 78*a*, 78*b* are identical in shape and function compared to the inside bearing housings 76*a*, 76*b*, the outside ones being distinguished from the inside ones mainly by orientation and location, and thus the illustrated bearing housing 78 is representative of all of the bearing housings 76*a*, 76*b*, 78*a*, 78*b*. Likewise, the outside forked paddles 60*a*, 60*b* are identical in shape and function to the inside forked paddles 58*a*, 58*b*, the outside ones being distinguished from the inside ones mainly by orientation and location, and thus the illustrated forked paddle 60 is representative of all of the forked paddles 58*a*, 58*b*, 60*a*, 60*b*.

The forked paddle 60 comprises the side paddle 61 that is fixedly attached to and extends upward from the bearing housing 78, and the bottom paddle 63 that is fixedly attached to and extends sideward from the side paddle 61. A paddle width W is dimensioned appropriately for massaging a desired length of whatever body part is placed into the support components 24. As will be seen from the following description, the massage intensity varies approximately proportionally with the paddle width W, since the wobble bearings 72, 74 cause wobbling motion of the forked paddles 58, 60 in all directions including "waving" from front 18 to back 20 of the massage device 10, and also including "twisting" about a vertical axis VA. In order to massage longer length body parts, an alternative to using a large paddle width W is to use a row of two or more paddle sets 59 with relatively narrow paddle widths W, the row comprising multiple drive shafts 38 arranged in parallel with a first drive shaft 38 being closest to the front surface 18, and additional drive shafts 38 being on the back surface 20 side of the first drive shaft 38. Each of the multiple drive shafts 38 would have wobble bearings 72*a*, 72*b*, 74*a*, 74*b* and associated housings and paddles as shown for the single set of drive shafts 38*a*, 38*b* illustrated in FIG. 3.

The paddles 61, 63 are illustrated as straight and flat elements, but it is within the scope of the invention to contour the paddles, e.g., to provide a shape that more closely matches the shape of the body part to be massaged, e.g., to have different paddle widths W at different locations on the paddles 61, 63. It is also within the scope of the invention to contour the rigidity of the paddles 61, 63, e.g., to make the paddles 61, 63 out of different rigid and/or semi-rigid materials, and to use ribs and/or thickness variations at different locations on the paddles 61, 63. For example, one embodiment of a side paddle 61, is a pear shape—widest near the bottom, made of a semi-rigid soft plastic, vertically curled slightly to curve around the side of a leg, and with a thickness that decreases from a vertical rib-reinforced central stem out to feathered edges.

The detaining fin 62 is relatively narrow, and is fixedly attached to and extends downward from the bearing housing 78. The detaining rod 36 is encompassed by the detaining fin 62 wherein the detaining rod 36 passes through a substantially vertical detaining slot 64 that is preferably dimensioned to be narrow enough to prevent substantial movement of the detaining fin 62 in any direction lateral to the detaining rod 36, thus preventing rotation of the bearing housing 78 even when the drive shaft 38 is causing a bearing journal 56 to rotate within the bearing housing 78 as indicated by a rotational direction arrow 39. The detaining slot 64 is, however, dimensioned to allow up and down movement and also twisting movement relative to the detaining rod 36 of a magnitude that is determined by the wobbling action of the wobble bearings 72, 74.

The representative wobble bearing 74 is preferably a sleeve-type bearing comprising the cylindrical journal 56 that is contained within the bearing housing 78 and is held in place by, for example, annular end flanges, at least one of which can be in the form of a removable end cap that is held on by screws. A suitable lubricant is provided between the bearing housing 78 and the bearing journal 56. Alternative embodiments of the wobble bearing 74 will be apparent and include, for example, a roller bearing having rollers between an outer ring (the bearing housing 78) and an inner ring (the bearing journal 56). An important feature of the wobble bearing 74 is that the drive shaft 38 passes through the journal 56 such that the rotational axis RA of the drive shaft 38 is at a non-zero wobble angle θ relative to the cylindrical axis (illustrated by a parallel cylindrical side line CS) of the journal 56. It may be noted that if a non-cylindrical journal 56 is utilized, e.g., a frustraconical journal, the "cylindrical axis" CS would be any line parallel to the geometric axis of revolution of the non-cylindrical shape. The journal 56 is rotationally engaged with the drive shaft 38 by a key 48 affixed longitudinally in the drive shaft 38 and extending radially outward into a keyway 50 cut longitudinally into a passage hole 57 of the journal 56. Preferably the keyway 50 is loose enough to be slidably engaged with the key 48, and the passage hole 57 is loose enough to be slidably engaged with the drive shaft 38, in order to enable sliding adjustment of the wobble bearing 74. Thus, rotation of the drive shaft 38 (indicated by the arrow 39) causes the journal 56 to rotate, which in turn causes the cylindrical axis CS to nutate about the rotational axis RA. Since the bearing housing 78 is prevented from rotating by the detaining rod 36, the nutating journal 56 causes the geometric axis of revolution of the bearing housing 78 to nutate as the angled bearing surface of the journal 56 rotates within the non-rotating bearing housing 78. The nutating but non-rotating bearing housing 78 therefore causes the attached forked paddle 60 to "wobble" in a complex combination of movements that include twisting back and forth around a vertical axis VA, associated tilting of the bottom paddle 63 back and forth around a horizontal axis HA, and tilting back and forth in the horizontal directions between the two extreme positions illustrated in FIG. 4 by the solid-line and the dashed-line drawings wherein the dashed-line illustrated position occurs whenever the drive shaft 38 has rotated 180° around from the solid-line illustrated position. The magnitude of the wobble angle θ is selected to determine a desired amount of horizontal movement of the side paddles 61 and a desired amount of vertical movement of the bottom paddles 63, thereby determining the magnitude and/or "intensity" of the kneading-type massage provided by the massage device 10. The length and width of the paddles 61, 63 obviously determine a multiplying factor on the effect of the wobble angle θ since horizontal and vertical movement at the paddle ends is approximately equal to the arc (2θ) times the distance of the paddle end from the rotational axis RA or half of the paddle width. For a typical sized massaging device 10, the wobble angle θ is generally between about 1° and about 15° , preferably between about 2° and about 10° , and most preferably between about 2° and about 7° . A wobble angle θ magnitude of 7° is shown in FIG. 4.

A hub 52 extends out one end of the journal 56 such that the hub 52 is forms a substantially annular sleeve with an inside surface that continues the passage hole 57 out from the one end of the journal 56. The keyway 50 also continues along the passage hole 57 along the entire length of the hub 52. The hub 52 for an adjustable wobble bearing 74, as illustrated in FIGS. 4 and 6, has flanges 54, the outer one of which may be removably attached with screws. The fixed wobble bearing 72 does not need the flanges 54, and is illustrated in FIG. 3 without them, but the flanges 54 could be present without affecting the operation of the fixed wobble bearing 72.

For a detailed understanding of the adjuster 80 and its operation in conjunction with the adjustable wobble bearing 74, please refer to FIGS. 6 and 7. The adjustable wobble bearing 74 is illustrated with the rotatably mounted outside bearing housing 78 that has the forked paddle 60 extending upward and the detaining fin 62 extending downward. The drive shaft 38 passes through the passage hole 57 in the journal 56 and in the hub 52 extending therefrom. The massager frame 40 rotatingly holds and supports the drive shaft 38 in a bearing 42, and also supports the adjuster 80.

The adjuster 80 comprises a lever assembly 86 that is threadingly engaged with a drive screw 84 at a first forked end 94 of a lever arm 90, is rotatingly engaged with the hub 52 on a second forked end 96 of the lever arm 90, and is pivotingly attached to a support arm 44 of the frame 40.

The drive screw 84 is a threaded portion of a shaft 106 that also has a preferably unthreaded portion that passes through a hole 107 in the frame 40 and extends out to where it is affixed to the knob 82. Spring clips 108 are used to substantially prevent in/out longitudinal movement of the shaft 106 and its drive screw 84. A drive nut 88 is threadingly engaged with the drive screw 84 and is prevented from rotating with the drive screw 84 by being bolted to the first forked end 94 of the lever arm 90. The drive nut 88 is slidingly and pivotingly bolted to the first forked end 94 by shoulder bolts 100 each having a shoulder that passes through a slot 95 such that the shoulder bolt 100 can rotate within and slide along the slot 95.

The pivoting attachment uses a pivot shoulder bolt 102 wherein its shoulder passes through a pivot hole 103 and is bolted to the support 44 such that the lever arm 90 is free to rotate about the pivot shoulder bolt 102. The position of the pivot hole 103 relative to the first and second forked ends 94, 96, is selected to provide a desired amount of leverage and movement of the first forked end 94 relative to the second forked end 96.

An annular sleeve 92 is rotatingly engaged with the hub 52 and is prevented from rotating with the hub 52 by being bolted to the second forked end 96 of the lever arm 90. The sleeve 92 is slidingly and pivotingly bolted to the second forked end 96 by shoulder bolts 104 each having a shoulder that passes through a slot 97 such that the shoulder bolt 104 can rotate within and slide along the slot 97. Flat lands 98 are provided on the otherwise curved outer surface of the sleeve 92 and the shoulder bolts 104 are bolted therein, thus trapping the second forked end 96 between two flat surfaces: the head of the shoulder bolt 104 and the land 98, thereby preventing rotation of the sleeve 92 with the hub 52. The sleeve 92 is also prevented from sliding longitudinally along the hub 52 by being contained between the flanges 54.

As described above, the adjuster 80 is used to move the adjustable wobble bearing 74 longitudinally along the drive shaft 38. Although the key 48 does not allow the hub 52 to rotate around the drive shaft 38, the keyway 50 in the hub 52 is dimensioned to allow longitudinal sliding of the key 52 in the keyway 50, and therefore to allow longitudinal sliding of the adjustable wobble bearing 74 along the drive shaft 38 as controlled by the adjuster 80. For example, rotating the knob 82 of the adjuster 80 can cause the adjustable wobble bearing 74 to longitudinally slide from a first position as shown in the solid-line illustration to a second position as shown in the dashed-line illustration.

In operation, the drive shafts 38 are rotated by the motor 32, preferably at a speed of between about 10 and about 30 revolutions per minute (rpm). As the shafts 38 rotate, the first and second paddle sets 59*a*, 59*b* wobble due to the resultant nutating action of the wobble bearing housings 76, 78 as described above. As a result, the forked paddles 58, 60 work together to press against and pull away from the sides 25 and bottoms 26 of the contoured support components 24 in a complex sequence of motions that can be experienced by a user who has placed a body part or parts (e.g., leg calves) into the contoured support components 24. The user will experience these motions as a kneading-type of massage having components of both squeezing and rolling pressure plus a smaller amount of rubbing-type massage pressure. Through the use of the adjuster(s) 80, the width of the trough-shaped support components can be varied, not only to adjust for different width body parts, but also to vary the maximum amount of pressure that will be experienced as the side paddles 61 squeeze together to their minimum separation as shown by the dashed-line illustration of FIG. 3. If a motor speed control is incorporated into the switch 30, then the speed of the massage (i.e., repetition rate) can be varied in order to adjust another component of what is experienced as "intensity" of the massage. Other adjustments of massage intensity are built in according to construction factors such as the selection of the wobble angle θ, selection of a length (height above the rotational axis RA) for the side paddles 61, selection of a length for the bottom paddles 63 (measured from the junction with the side paddle 61), and selection of a width W for the side and bottom paddles 61, 63 respectively.

Although the invention has been illustrated and described in detail in the drawings and foregoing description, the same is to be considered as illustrative and not restrictive in character—it being understood that only preferred embodiments have been shown and described, and that all changes and modifications that come within the spirit of the invention are desired to be protected. Undoubtedly, many other "variations" on the "themes" set forth hereinabove will occur to one having ordinary skill in the art to which the present invention most nearly pertains, and such variations are intended to be within the scope of the invention, as disclosed herein.

The invention claimed is:

1. A massage device for massaging one or more body parts, the massage device comprising:

flexible support components adapted to support a body part;

at least one forked paddle comprising a first paddle and a second paddle, wherein the first paddle extends outward from the side of a housing rotatably mounted on a wobble bearing journal of a wobble bearing and extends generally vertical along a side of the support components, wherein the second paddle extends generally horizontal from the first paddle and under a bottom of the support components;

a drive shaft driven by a rotational motive device, and rotationally engaged with a passage of the journal, wherein the passage passes through the journal at a nonzero wobble angle measured between a rotational axis of the drive shaft and a geometric axis of revolution of the journal;

a detaining fin attached to the housing and encompassing a detaining rod; and a frame that fixedly holds the detaining rod and rotationally holds the drive shaft.

2. The massage device of claim 1, wherein:

the flexible support components having at least one trough-shaped support that includes two opposed sides and one bottom; and at least one paddle set comprising a first forked paddle arranged on one of the two opposed sides, and a second forked paddle arranged on the other one of the two opposed sides.

3. The massage device of claim 2, wherein the single drive shaft is rotationally engaged with both of a first wobble bearing that is associated with the first forked paddle, and a second wobble bearing that is associated with the second forked paddle.

4. The massage device of claim 2, wherein:

the flexible support components comprise a first trough-shaped support that is generally parallel to a second trough-shaped support; and a first paddle set arranged about the first trough-shaped support of the flexible support components and a similar second paddle set arranged about the second trough-shaped support of the flexible support components.

5. The massage device of claim 3, further including an adjuster connected to at least one of the first and second wobble bearings for longitudinal sliding adjustment of wobble bearing position along the drive shaft.

6. The massage device of claim 1 wherein the wobble angle is in the range of between about 1° and about 15°.

7. The massage device of claim 1 wherein the wobble angle is in the range of between about 2° and about 10°.

8. The massage device of claim 1 wherein the wobble angle is in the range of between about 2° and about 7°.

9. The massage device of claim 1, further including a remote control for controlling massage intensity.

* * * * *